US005527158A

United States Patent [19]

Ramsey et al.

[11] Patent Number: 5,527,158

[45] Date of Patent: Jun. 18, 1996

[54] SCROLL MACHINE WITH OVERHEATING PROTECTION

[75] Inventors: Jeffery D. Ramsey, Englewood; Jean-Luc Caillat, Dayton; Sunil S. Kulkarni, Fairborn, all of Ohio

[73] Assignee: Copeland Corporation, Sidney, Ohio

[21] Appl. No.: 313,067

[22] PCT Filed: Mar. 26, 1992

[86] PCT No.: PCT/US92/02462

§ 371 Date: Dec. 9, 1994

§ 102(e) Date: Dec. 9, 1994

[87] PCT Pub. No.: WO93/19295

PCT Pub. Date: Sep. 30, 1993

Related U.S. Application Data

[63] Continuation-in-part of Ser. No. 591,428, Oct. 1, 1990.

[51] Int. Cl.[6] ..... F04B 49/10

[52] U.S. Cl. ..... 417/32; 417/292; 417/310; 62/126; 236/93 R

[58] Field of Search ..... 417/32, 292, 310; 62/126, 129; 236/93 R

[56] References Cited

U.S. PATENT DOCUMENTS

| | | | |
|---|---|---|---|
| 4,383,805 | 5/1983 | Teegarden et al. . | |
| 4,456,435 | 6/1984 | Hiraga et al. . | |
| 4,496,296 | 1/1985 | Arai et al. . | |
| 4,505,651 | 3/1985 | Terauchi et al. . | |
| 4,514,150 | 4/1985 | Hiraga et al. . | |
| 4,560,330 | 12/1985 | Murayama et al. . | |
| 4,586,653 | 5/1986 | Föller et al. . | |
| 4,596,520 | 6/1986 | Arata et al. . | |
| 4,596,521 | 6/1986 | Murayama et al. . | |
| 4,669,962 | 6/1987 | Mizuno et al. . | |
| 4,714,415 | 12/1987 | Mizuno et al. . | |
| 4,744,733 | 5/1988 | Terauchi et al. . | |
| 4,820,130 | 4/1989 | Eber et al. | 417/32 |
| 4,828,462 | 5/1989 | McBurnett | 417/310 |
| 4,840,545 | 6/1989 | Moilanen . | |
| 4,846,633 | 7/1989 | Suzuki et al. . | |
| 4,995,553 | 2/1991 | Foller et al. . | |
| 5,090,880 | 2/1992 | Mahimo | 417/310 |

FOREIGN PATENT DOCUMENTS

| | | |
|---|---|---|
| 57-110789A | 9/1982 | Japan . |
| 59119080 | 12/1982 | Japan . |
| 6066892 | 10/1983 | Japan . |
| 6078997 | 11/1983 | Japan . |
| 60-243388 | 5/1984 | Japan . |
| 60-75796A | 4/1985 | Japan . |
| 61-17490 | 1/1986 | Japan . |
| 61-89990 | 5/1986 | Japan . |
| 61-87988 | 5/1986 | Japan . |
| 61-218792 | 9/1986 | Japan . |
| 61-218792A | 9/1986 | Japan . |
| 61-144284 | 9/1986 | Japan . |
| 61-145892 | 9/1986 | Japan . |
| 63-134894 | 6/1988 | Japan . |

*Primary Examiner*—Richard A. Bertsch
*Assistant Examiner*—Xuan M. Thai
*Attorney, Agent, or Firm*—Harness, Dickey & Pierce

[57] ABSTRACT

A thermally responsive valve assembly (134) for scroll motorcompressor high temperature protection, which causes a high-side to low-side leak when excessive discharge gas temperatures are encountered, thereby causing the motor protector (35) to trip and de-energize the motor. The valve assembly (134) includes means motor ducting (200) the excessive temperature discharge gas to the lower portion of the motor/compressor shell (10) to the motor to circulate the high temperature gas throughout the motor cavity. The excessive temperature discharge gas heats the motor stator (20) and windings (32) which will in turn cause the motor protector (35) to trip and de-energize the motor.

47 Claims, 6 Drawing Sheets

SCROLL MACHINE WITH OVERHEATING PROTECTION

This application is a continuation-in-part of U.S. application Ser. No. 07/591,428 filed Oct. 1, 1990 and entitled "Scroll Machine with Overheating Protection".

The present invention relates to scroll-type machinery, and more particularly to scroll compressors having unique means for protecting the machine from overheating.

BACKGROUND AND SUMMARY OF THE INVENTION

A typical scroll machine has an orbiting scroll member having a spiral wrap on one face thereof, a non-orbiting scroll member having a spiral wrap on one face thereof with said wraps being entermeshed with one another, and means for causing said orbiting scroll member to orbit about an axis with respect to said non-orbiting scroll member, whereby said wraps will create pockets of progressively decreasing volume from a suction zone to a discharge zone.

It has been discovered that one of the unique features of scroll machines is that excessive high temperature discharge gas conditions (which result from the high pressure ratios caused by many different field-encountered problems) can be solved by providing means to cause a high-side to low-side leak during these conditions.

It is therefore one of the primary objects of the present invention to provide an improved mode of temperature protection which is extremely simple in construction, utilizing a simple temperature responsive valve, and which is easy to install and inspect, and which effectively provides the control desired. The valve of the present invention has been discovered to be particularly good at providing pressure relief and hence high temperature protection, particularly in motor-compressors where suction gas is used to cool the motor. This is because the valve will create a leak from the high side to the low side at discharge temperatures which are significantly higher than those for which the machine was designed. This leakage of discharge fluid which is directed towards the motor disposed in the lower portion of the shell which is on the suction side of the compressor essentially causes the machine to cease any significant pumping, and the resulting heat build-up of the motor components and lack of flow of relatively cool suction gas will cause the standard motor protector to trip and shut the machine down. The present invention therefore provides protection from excessive discharge temperatures which could result from (a) loss of working fluid charge, or (b) a blocked condenser fan in a refrigeration system, or (c) a low pressure condition or a blocked suction condition or (d) an excess discharge pressure condition for any reason whatever. All of these desirable conditions will cause a scroll machine to function at a pressure ratio much greater than that which is designed into the machine in terms of its predetermined fixed volume ratio, and this will in turn cause excessive discharge temperatures.

These and other objects and advantages will become more apparent when viewed in light of the accompanying drawings and following detailed description.

DETAILED DESCRIPTION OF THE PREFERRED EMBODIMENTS

Figure 1:
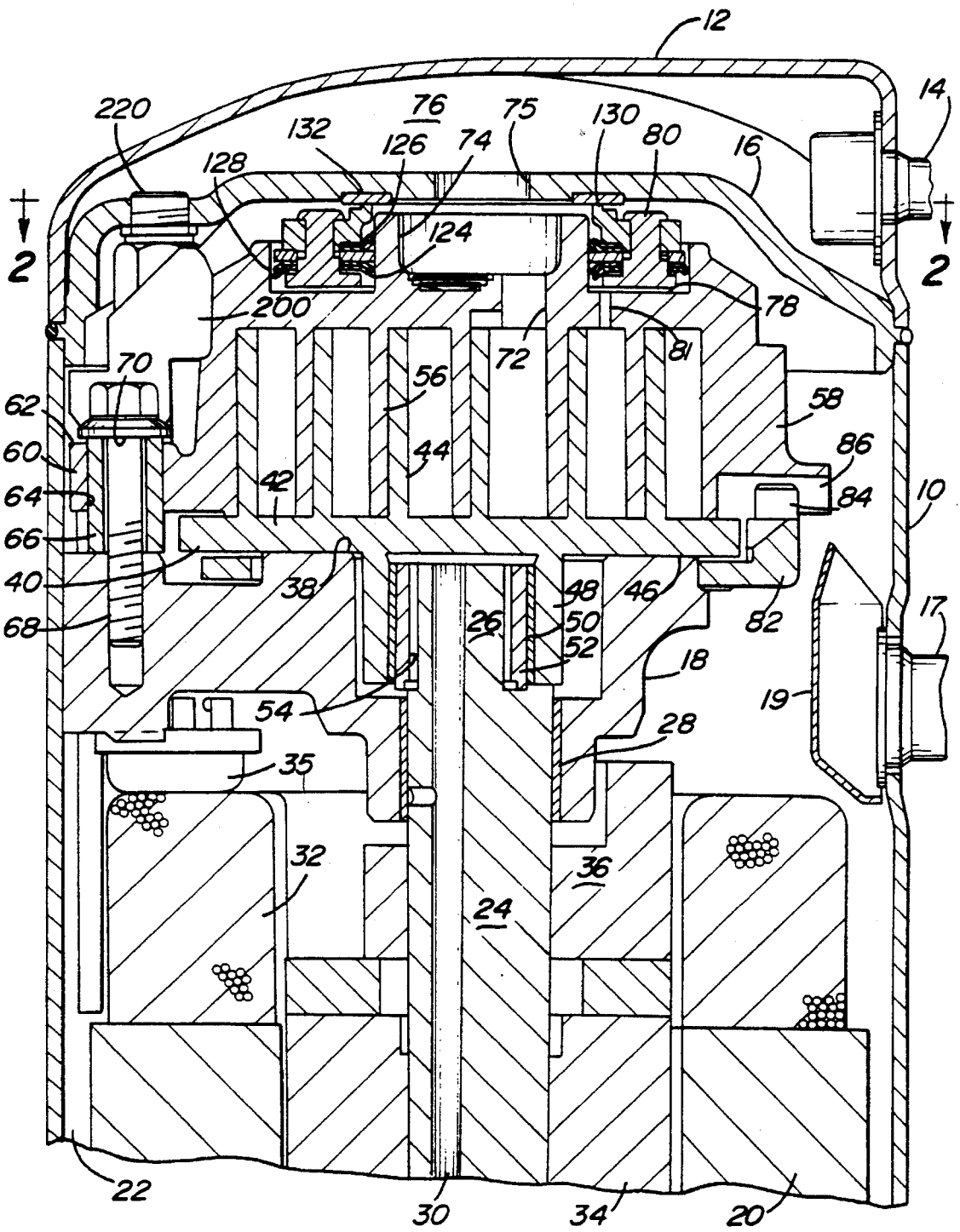
FIG. 1 is a partial vertical sectional view through line 1—1 of FIG. 2 of a scroll machine embodying the principles of the present invention.
Figure 2:
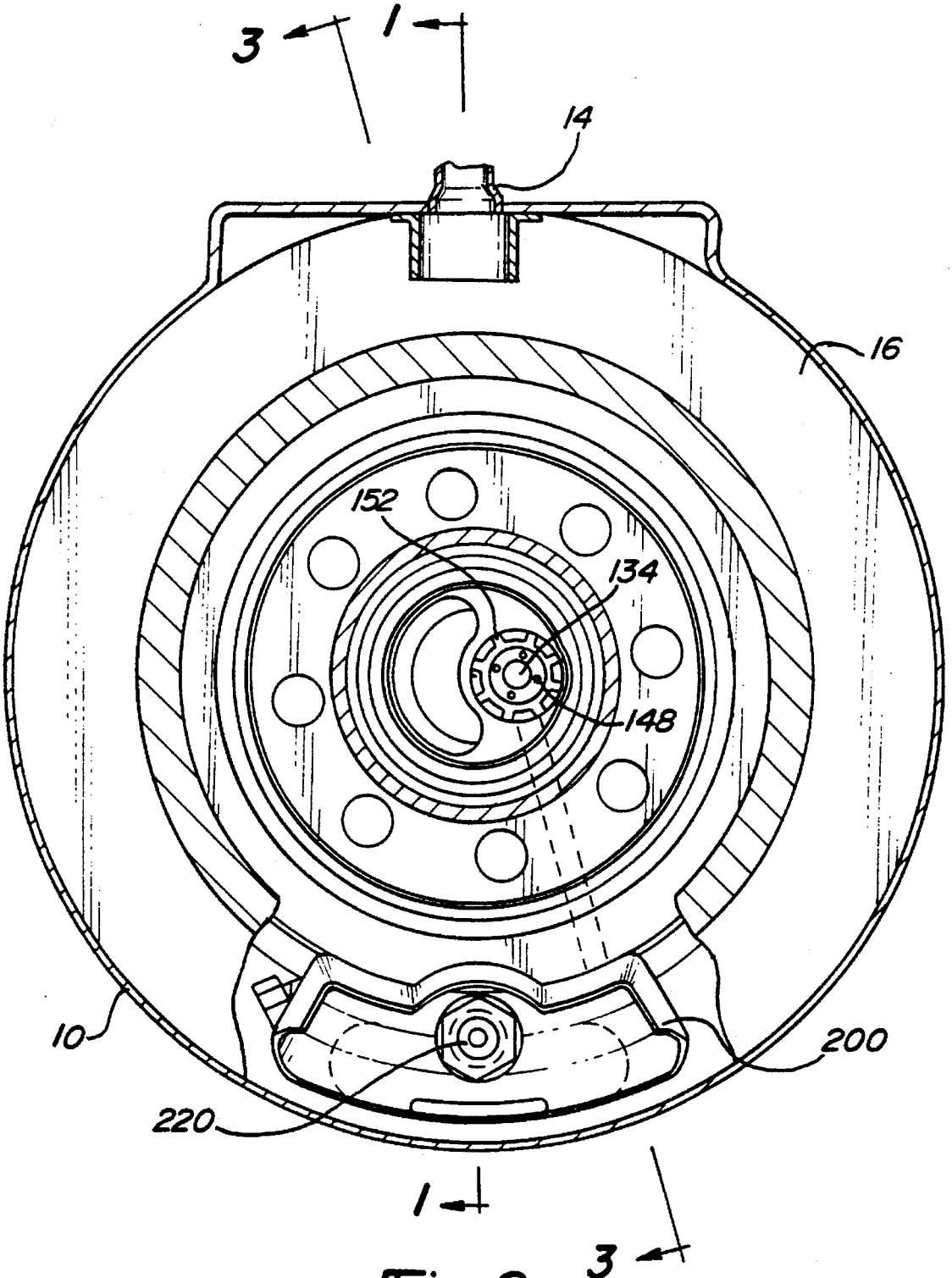
FIG. 2 is a top plan view partially in cross section of the scroll machine shown in FIG. 1.

While the present invention is suitable for incorporation in many different types of scroll machines, for exemplary purposes it will be described herein incorporated in a hermetic scroll refrigerant motor-compressor of the "low side" type (i.e., where the motor and compressor are cooled by suction gas in the hermetical shell, as illustrated in vertical section in FIG. 1). Generally speaking, the compressor comprises a cylindrical hermetic shell 10 having welded at the upper end thereof a cap 12, which is provided with a refrigerant discharge fitting 14 optionally having the usual discharge valve therein (not shown). Other elements affixed to the shell include a transversely extending partition 16 which is welded about its periphery at the same point that cap 12 is welded to shell 10, a main bearing housing 18 which is affixed to shell 10 at a plurality of points in any desirable manner, and a suction gas inlet fitting 17 having a gas deflector 19 disposed in communication therewith inside the shell.

A motor stator 20 which is generally square in cross-section but with the corners rounded off is press fit into shell 10. The flats between the rounded corners on the stator provide passageways between the stator and shell, indicated at 22, which facilitate the flow of lubricant from the top of the shell to the bottom. A crankshaft 24 having an eccentric crank pin 26 at the upper end thereof is rotatably journaled in a bearing 28 in main bearing housing 18 and a second bearing 42 in a lower bearing housing 41. Crankshaft 24 has at the lower end the usual relatively large diameter oil-pumping concentric bore 43 which communicates with a radially outwardly inclined smaller diameter bore 30 extending upwardly therefrom to the top of the crankshaft. The lower portion of the interior shell 10 is filled with lubricating oil in the usual manner and the pump at the bottom of the crankshaft is the primary pump acting in conjunction with bore 30, which acts as a secondary pump, to pump lubricating fluid to all the various portions of the compressor which require lubrication.

Crankshaft 24 is rotatively driven by an electric motor including stator 20 having windings 32 passing therethrough, and a rotor 34 press fit on the crankshaft and having one or more counterweights 36. A motor protector 35, of the usual type, is provided in close proximity to motor windings 32 so that if the motor exceeds its normal temperature range the protector will de-energize the motor.

The upper surface of main bearing housing 18 is provided with an annular flat thrust bearing surface 38 on which is disposed an orbiting scroll member 40 comprising an end plate 42 having the usual spiral vane or wrap 44 on the upper surface thereof, an annular flat thrust surface 46 on the lower surface, and projecting downwardly therefrom a cylindrical hub 48 having a journal bearing 50 therein and in which is rotatively disposed a drive bushing 52 having an inner bore 54 in which crank pin 26 is drivingly disposed. Crank pin 26 has a flat on one surface (not shown) which drivingly engages a flat surface in a portion of bore 54 (not shown) to provide a radially compliant driving arrangement, such as shown in assignee's U.S. Pat. No. 4,877,382, the disclosure of which is herein incorporated by reference.

Wrap 44 meshes with a non-orbiting spiral wrap 56 forming a part of non-orbiting scroll member 58 which is mounted to main bearing housing 18 in any desired manner which will provide limited axial movement of scroll member 58. The specific manner of such mounting is not relevant to the present inventions, however, in the present embodiment, for exemplary purposes, non-orbiting scroll member 58 has a plurality of circumferentially spaced mounting bosses 60, one of which is shown, each having a flat upper surface 62 and an axial bore 64 in which is slidably disposed a sleeve 66 which is bolted to main bearing housing 18 by a bolt 68 in the manner shown. Bolt 68 has an enlarged head having a flat lower surface 70 which engages surface 62 to limit the axially upper or separating movement of non-orbiting scroll member, movement in the opposite direction being limited by axial engagement of the lower tip surface of wrap 56 and the flat upper surface of orbiting scroll member 40. For a more detailed description of the non-orbiting scroll suspension system, see applicants' assignee's copending application entitled Non-Orbiting Scroll Mounting Arrangement For A Scroll Machine, U.S. patent application Ser. No. 07/591,444 and filed Oct. 1, 1990, the disclosure of which is hereby incorporated herein by reference.

Non-orbiting scroll member 58 has a centrally disposed discharge passageway 72 communicating with an upwardly open recess 74 which is in fluid communication via an opening 75 in partition 16 with the discharge muffler chamber 76 defined by cap 12 and partition 16. An intermediate pressure relief valve 220 is disposed between the discharge muffler chamber 76 and the interior of shell 10. The intermediate relief valve 220 will open at a specified excessive pressure and vent pressurized gas from the discharge muffler chamber 76 to the ducting system 200. Non-orbiting scroll member 58 has in the upper surface thereof an annular recess 78 having parallel coaxial side walls in which is sealingly disposed for relative axial movement an annular floating seal 80 which serves to isolate the bottom of recess 78 from the presence of gas under suction and discharge pressure so that it can be placed in fluid communication with a source of intermediate fluid pressure by means of a passageway 81. The non-orbiting scroll member is thus axially biased against the orbiting scroll member by the forces created by discharge pressure acting on the central portion of scroll member 58 and those created by intermediate fluid pressure acting on the bottom of recess 78. This axial pressure biasing, as well as various techniques for supporting scroll member 58 for limited axial movement, are disclosed in much greater detail in assignee's aforesaid U.S. Pat. No. 4,877,328.

Relative rotation of the scroll members is prevented by the usual Oldham coupling comprising a ring 82 having a first pair of keys 84 (one of which is shown) slidably disposed in diametrically opposed slots 86 (one of which is shown) in scroll member 58 and a second pair of keys (not shown) slidably disposed in diametrically opposed slots in scroll member 40.

Although the details of construction of floating seal 80 are not part of the present invention, for exemplary purposes seal 80 is of a coaxial sandwiched construction and comprises an annular base plate 100 having a plurality of equally spaced upstanding integral projections 102 each having an enlarged base portion 104. Disposed on plate 100 is an annular gasket 106 having a plurality of equally spaced holes which receive base portions 104, on top of which is disposed a pair of normally flat identical lower lip seals 108 formed of glass filled PTFE. Seals 108 have a plurality of equally spaced holes which receive base portions 104. On top of seals 108 is disposed an annular spacer plate 110 having a plurality of equally spaced holes which receive base portions 104, and on top of plate 110 are a pair of normally flat identical annular upper lip seals 112 formed of a same material as lip seals 108 and maintained in coaxial position by means of an annular upper seal plate 114 having a plurality of equally spaced holes receiving projections 102. Seal plate 114 has disposed about the inner periphery thereof an upwardly projecting planar sealing lip 116. The assembly is secured together by swaging the ends of each of the projections 102, as indicated at 118.

The overall seal assembly therefor provides three distinct seals; namely, an inside diameter seal at 124 and 126, an outside diameter seal at 128 and a top seal at 130, as best seen in FIG. 1. Seal 124 is between the inner periphery of lip seals 108 and the inside wall of recess 78, and seal 126 is between the inner periphery of lip seals 112 and the inside wall of recess 78. Seals 124 and 126 isolate fluid under intermediate pressure in the bottom of recess 78 from fluid under discharge pressure in recess 74. Seal 128 is between the outer periphery of lip seals 108 and the outer wall of recess 78, and isolates fluid under intermediate pressure in the bottom of recess 78 from fluid at suction pressure within shell 10. Seal 130 is between lip seal 116 and an annular wear ring 132 surrounding opening 75 in partition 16, and isolates fluid at suction pressure from fluid at discharge pressure across the top of the seal assembly. The details of construction of seal 80 are more fully described in applicant's assignee's copending application for U.S. patent application Ser. No. 07/591,454, filed Oct. 1, 1990 and entitled Scroll Machine With Floating Seal, the disclosure of which is hereby incorporated herein by reference.

The compressor is preferably of the "low side" type in which suction gas entering via deflector 19 is allowed, in part, to escape into the shell and assist in cooling the motor. So long as there is an adequate flow of returning suction gas the motor will remain within desired temperature limits. When this flow drops significantly, however, the loss of cooling will eventually cause motor protector 35 to trip and shut the machine down.

The scroll compressor as thus far broadly described with the exception of ducting system 200 is either now known in the art or is the subject matter of other pending applications for patent by applicant's assignee. The details of construction which incorporate the principles of the present invention are those which deal with a unique temperature responsive valve assembly, indicated generally at 134, and a system for ducting discharge gases closer to the motor space, indicated generally at 200. The temperature responsive valve 146 and the intermediate pressure relief valve 220 cause the compressor to cease any significant pumping if the discharge gas reaches excessive temperatures or pressures respectively. The ceasing of pumping action deprives the motor of its normal flow of cooling gas. The excessive temperature discharge gas is ducted directly to the lower portion of motor space where it is circulated around and through the motor thus increasing the temperature of the stator 20 and the windings 32. This increase in temperature of the stator 20 and the windings 32 in conjunction with the circulating excessive temperature discharge gas will heat the standard motor protector 35 which will then trip and de-energize the motor.

Figure 3:
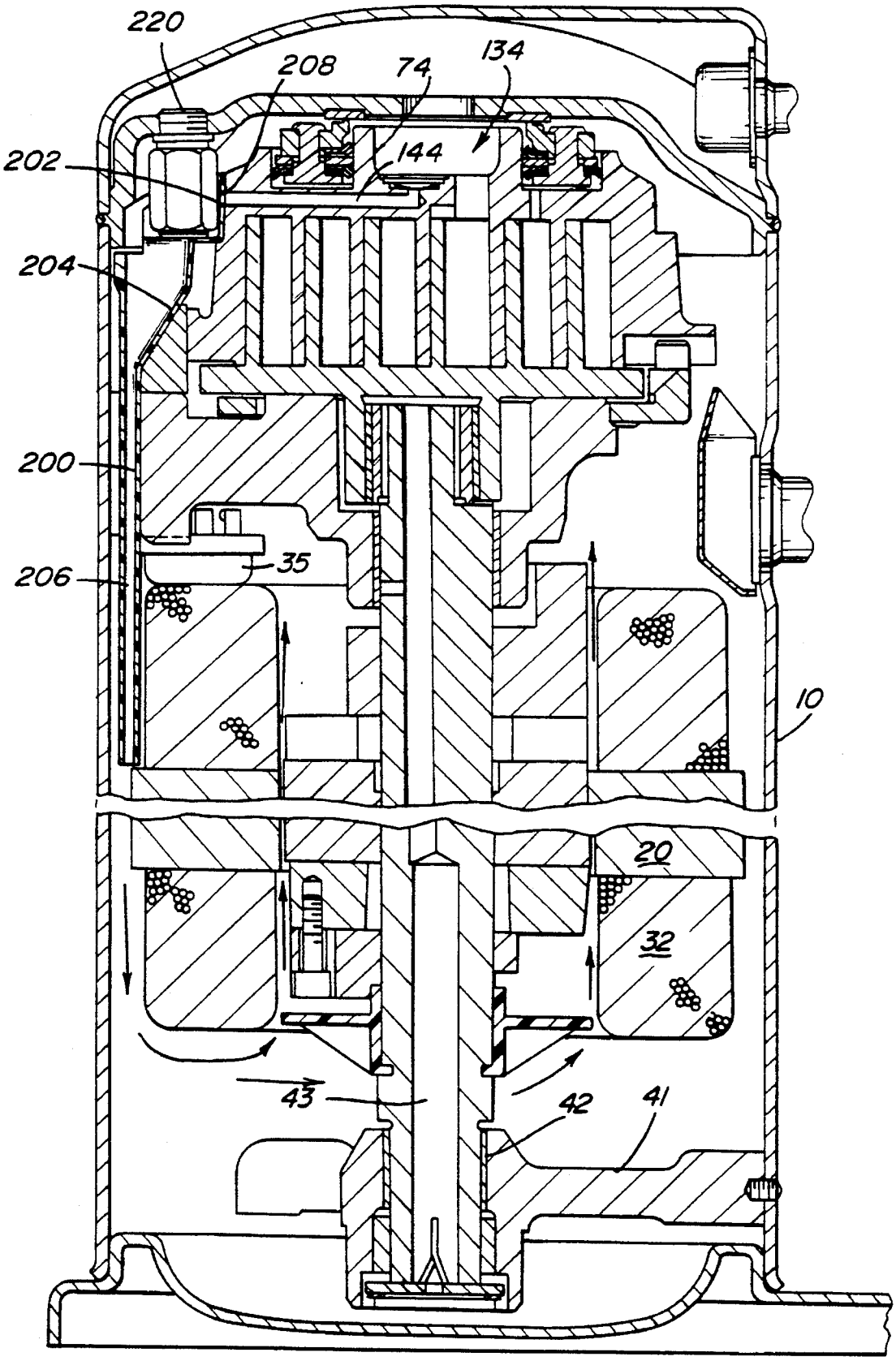
FIG. 3 is a partial vertical sectional view through the scroll machine along line 3—3 of FIG. 2.
Figure 4:
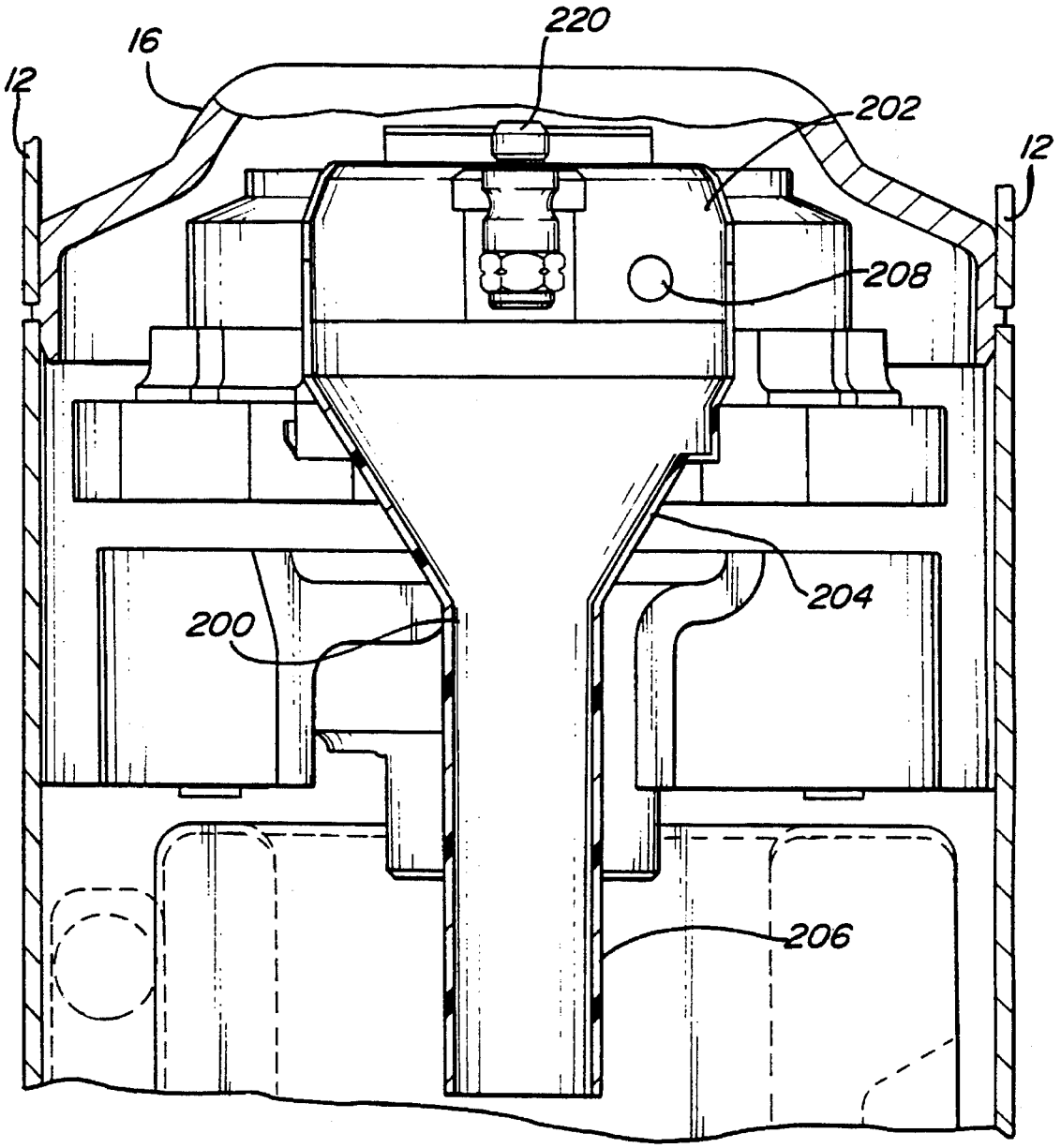
FIG. 4 is a partial vertical sectional view through the scroll machine in the direction of arrow 4 in FIG. 2.
Figure 9:
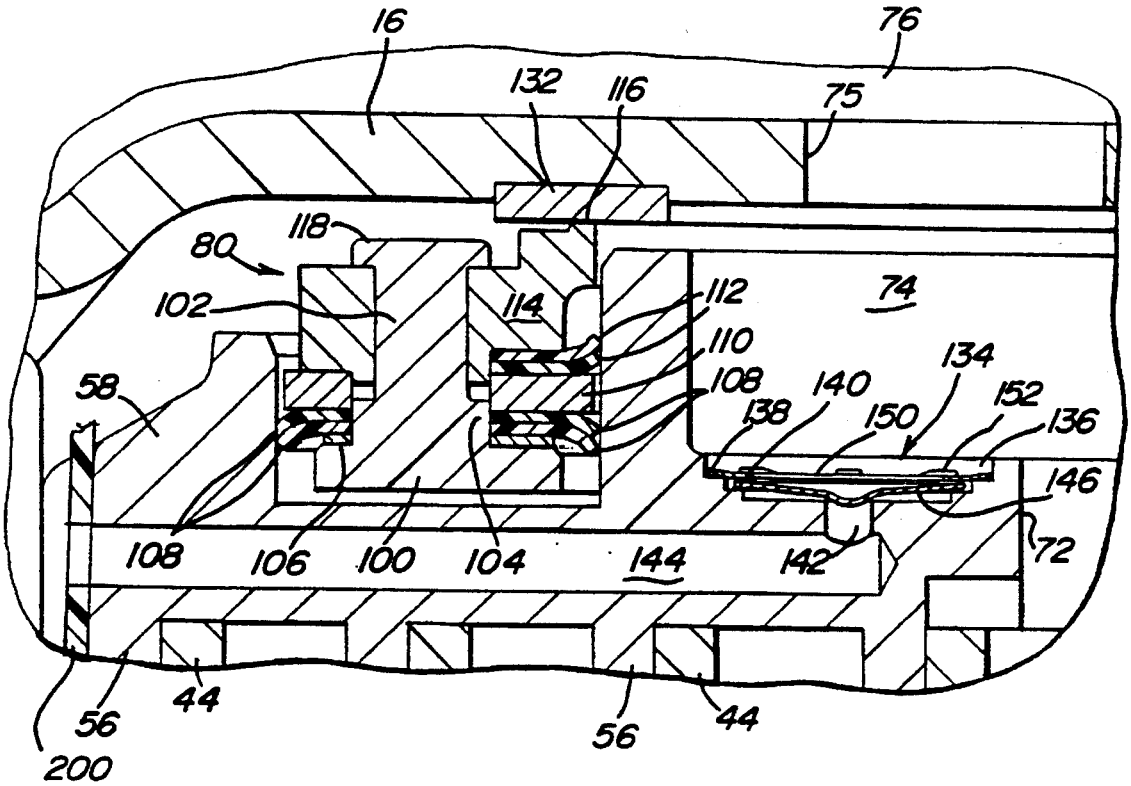
FIG. 9 is an enlarged vertical sectional view of a thermally responsive valve forming a part of the invention and shown in its normally closed state.

The temperature responsive valve assembly 134 of the present invention, best seen in FIGS. 3 and 9, comprises a circular valve cavity 136 disposed in the bottom of recess 74 and having annular coaxial peripheral steps 138 and 140 of decreasing diameter, respectively. The bottom of cavity 136 communicates with an axial passage 142 of circular cross-section, which in turn communicates with a radial passage 144, the radially outer outlet end of which is in communication with a ducting system 200 which is in turn in communication with suction gas within shell 10. The ducting system 200 consists of a first generally partially annular section 202, a funneling section 204 and a second partially annular section 206. The first generally partially annular section 202 is shaped to communicate with both the radial passage 144 and the pressure relief valve 220. The actual shape of annular section 202 is such that it easily fits into the open area in the upper portion of the motor/compressor assembly. The annular section 202 has a circular opening 208 which is in communication with radial passage 144. The annular section 202 acts as an accumulator for the excessive temperature discharge gas. The annular section 202 also surrounds the intermediate pressure relief valve 220 in order to direct any of the excessive pressure discharge gas which is released by relief valve 220 to specific areas within the shell 10.

The annular section 202 is in communication with the funneling section 204 which funnels the excessive temperature discharge gas to annular section 206 which is also in communication with funneling section 204. The discharge end of the annular section 206 is positioned to direct the excessive temperature discharge gas to the lower portion of the shell 10 as shown in FIG. 3 and more specifically to one of the passageways 22 extending radially between the stator 20 and outer shell 10. This excessive discharge gas circulates through passageway 22 and the areas around the motor stator 20. The gas is drawn through the gap between the motor stator 20 and rotor 34 as shown by the arrows in FIG. 3. The excessive temperature discharge gas serves to further heat the motor protector, the motor stator, windings and rotor. This increase in heat, coupled with the loss of normal cooling suction gas will cause the motor protector 35 to trip and deenergize the motor.

The intersection of passage 142 and the planar bottom of cavity 136 defines a circular valve seat, in which is normally disposed the spherical center valving portion of a circular slightly spherical relatively thin saucer-like bimetallic valve 146 having a plurality of through holes 148 disposed outwardly of the spherical valving portion.

Valve 146 is retained in place by a circular generally annular spider-like retainer ring 150 which has an open center portion and a plurality of spaced radially outwardly extending fingers 152 which are normally of a slightly larger diameter than the side wall of cavity 136. After valve 146 is assembled in place, retainer 150 is pushed into cavity 136 until it bottoms out on step 138, and is held in place by fingers 152 which bitingly engage the side wall of cavity 136. In FIG. 9 valve 146 is shown in its normally closed position (i.e., slightly concave downwardly with its peripheral rim disposed between retainer 150 and step 140 and its center valving portion closing passageway 142.

Being disposed in discharge gas recess 74, valve 146 is fully exposed to the temperature of the discharge gas very close to the point it exits the scroll wraps (obviously, the closer the location at which the discharge gas temperature is sensed is to the actual temperature of the discharge gas existing in the last scroll compression pocket the more accurately the machine will be controlled in response to discharge pressure). The materials of bimetallic valve 146 are chosen, using conventional criteria, so that when discharge gas temperature reaches a predetermined value which is considered excessive, the valve will "snap" into its open position in which is slightly concave upwardly with its outer periphery engaging step 140 and its center valving portion elevated away from the valve seat. In this position, high pressure discharge fluid can leak through holes 148 and passages 142 and 144 to the interior of annular section 202, to the funneling section 204, to the second annular section 206 and finally to the lower portion of the shell 10. This leakage causes the discharge gas to be recirculated thus reducing the inflow of cool suction gas as a consequence of which the motor loses its flow of cooling medium, i.e., the inlet flow of relatively cool suction gas. The motor protector 35, motor windings and stator therefore heat up due to both the presence of relatively hot discharge gas and reduced flow of suction gas. The motor windings and stator act as a heat sink to eventually trip motor protector 35, thus shutting down the compressor.

If the excessive temperature discharge gas is simply vented directly to the suction gas chamber, the suction action of the compressor would limit the amount of circulation within the shell 10 of the excessive temperature gas. The excessive temperature gas will go through the compressor again and have its temperature increased further. This continuous increase of the temperature of the discharge gas will continue until the motor protector 35 trips. The delay caused by the limited recirculation of the discharge gas can allow the discharge gas to reach temperatures which are above those desired. By ducting the excessive temperature discharge gas to the lower portion of the shell 10 and allowing it to circulate throughout the motor space as shown in FIG. 3, the motor protector, the motor stator and windings are heated which will then trip the motor protector 35 in a much more reliable and predictable manner.

Figure 6:
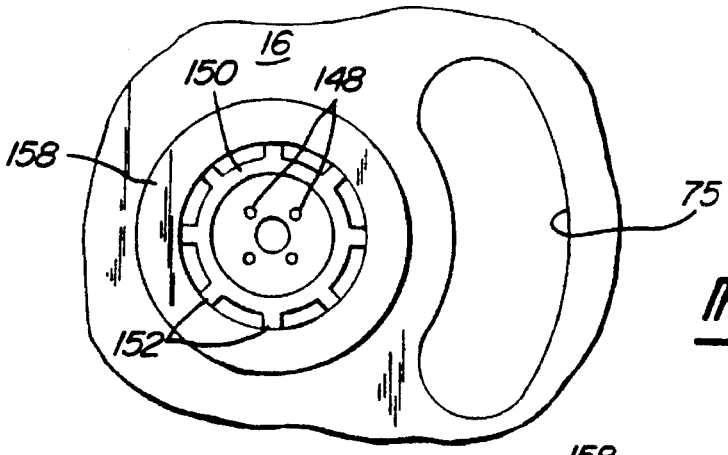
FIG. 6 is a top plan view of the embodiment of FIG. 5.
Figure 5:
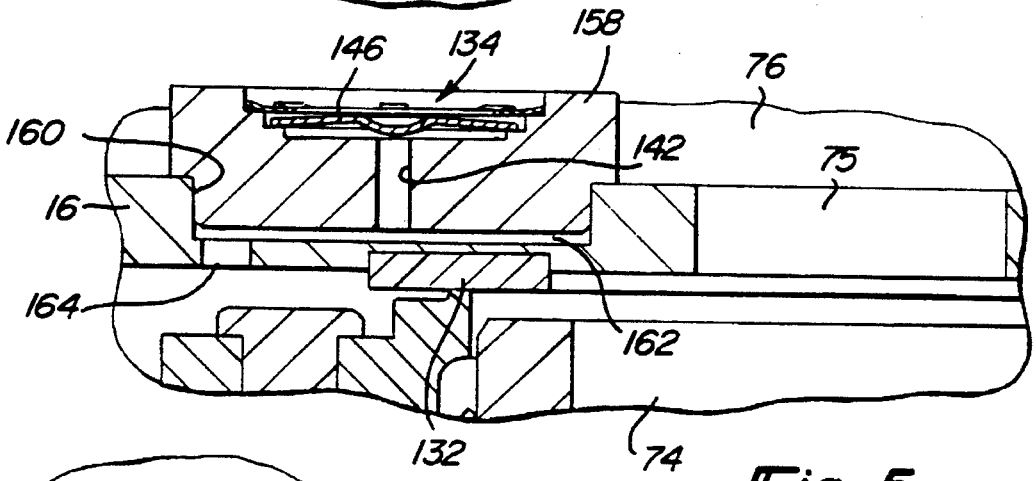
FIG. 5 is an enlarged vertical section view of a second embodiment of the present invention showing the thermally responsive valve in its open state.

In the embodiment of FIGS. 5 and 6 valve assembly 134 is located on partition 16 rather than in recess 74 where there could be serious space constraints in certain compressor designs. Here valve assembly 134 is mounted in a fitting 158 which is secured to partition 16 in a fluid bore 160 in any suitable manner, with the bottom of fitting 158 being spaced slightly from the bottom of bore 160 to define a cavity 162. The top of the valve assembly is exposed to discharge gas in discharge muffler 76, and when excessive temperatures are encountered valve 146 opens to permit leaking from the discharge muffler through the valve into cavity 162 via passage 142. From there, the leaking gas flows through an axial passage 164 disposed outside wear ring 132 into the partially annular section 202 of the ducting system 200 which is in communication with axial passage 164. This embodiment otherwise functions in exactly the same way as the embodiment of FIGS. 1–4.

Figure 8:
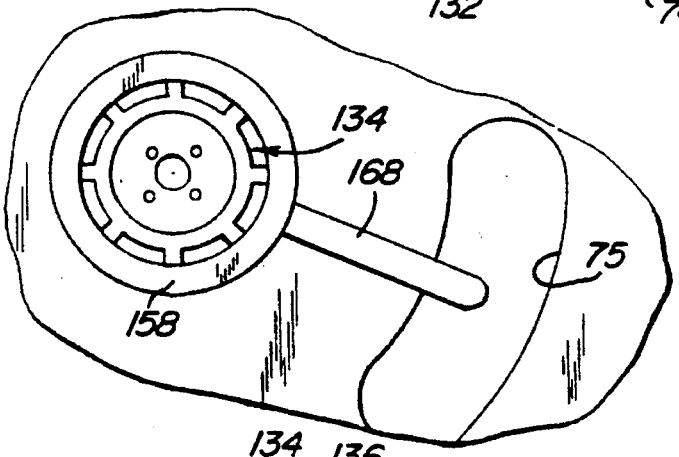
FIG. 8 is a top plan view of the embodiment of FIG. 7.
Figure 7:
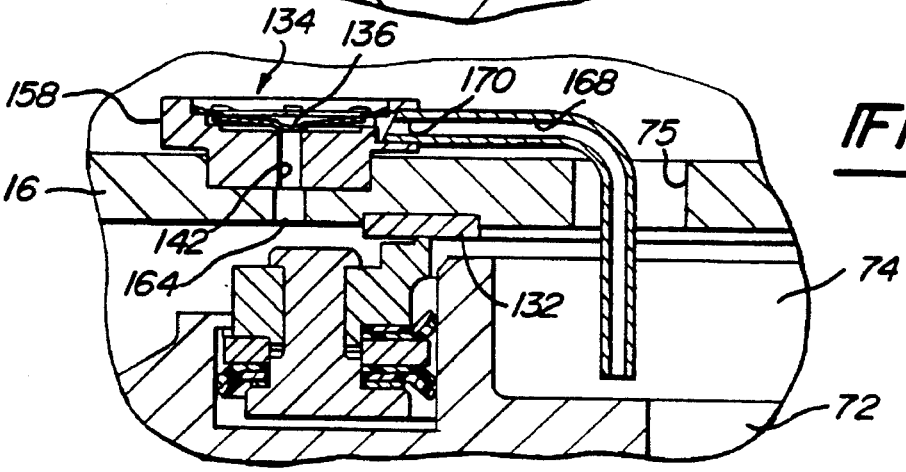
FIG. 7 is an enlarged vertical sectional view of a third embodiment of the present invention.

The embodiment of FIGS. 7 and 8 is essentially the same in design and function as the embodiment of FIGS. 5 and 6 except that there is provided an L-shaped tube 168 having one end disposed in a bore 170 in fitting 158, which communicates with valve cavity 136, and the opposite end disposed immediately adjacent discharge port 72, for the purpose of making the valve more sensitive to temperatures closer to the compressing mechanism. The closer the temperature sensed is to the actual compressor discharge gas temperature, the more accurate and reliable is the control.

Figure 10:
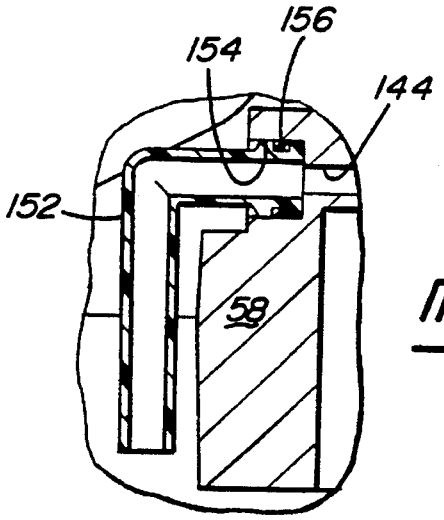
FIG. 10 is a fragmentary view similar to that of FIG. 9 showing a possible modification of the apparatus of the present invention.

FIG. 10 shows a possible modification wherein an L-shaped plastic extension tube 152 is inserted into a counterbore 154 in passage 144, using an elastomeric seal 156, to carry bypass or "leaked" gas from passage 144 downwardly past the suction zone of the compressor and even closer to the motor space, thereby reducing undesirable excessive heating of the suction gas and thereby increasing motor temperature. Although it is intended to let the motor heat up so that the protector will trip, it is not good to let the suction gas and hence discharge gas to get any hotter than they already are at this point. Overly excessive discharge temperatures will destroy the lubricant and damage the compressor.

While this invention has been described in connection with these particular examples, no limitation is intended except as defined by the following claims. The skilled practitioner will realize that other modifications may be made without departing from the spirit of this invention after studying the specification and drawings.

We claim:

1. A scroll compressor comprising:

(a) a hermetic shell having a motor cavity;

(b) an orbiting scroll member disposed in said shell and having a first spiral wrap on one face thereof;

(c) a non-orbiting scroll member disposed in said shell and having a second spiral wrap on one face thereof, said wraps being entermeshed with one another;

(d) a motor disposed in said motor cavity of said shell for causing said orbiting scroll member to orbit about an axis with respect to said non-orbiting scroll member whereby said wraps will create pockets of progressively decreasing volume from a suction zone at suction pressure to a discharge zone at discharge pressure;

(e) means for introducing suction gas into said shell;

(f) passage means defining a passageway in fluid communication at one end with a sensing zone of compressed gas from said compressor which is at a pressure higher than said suction pressure and at the other end in fluid communication with said motor cavity of said shell;

(g) normally closed valve means in said passage means for controlling gas flow therethrough, said valve operating in response to a sensed condition in said sensing zone in excess of a predetermined value to open said passage means and thereby permit the leakage of compressed gas from said sensing zone to said motor cavity of said shell; and (h) a thermal protector associated with said motor for de-energizing said motor when said thermal protector reaches a predetermined excessive temperature, and wherein said leakage of said compressed gas causes an increase in the temperature of said motor and said thermal protector, thereby causing said thermal protector to reach said excessive temperature and de-energize said motor.

2. A scroll compressor as claimed in claim 1 wherein said valve means is a thermal responsive valve and said sensed condition is gas temperature.

3. A scroll compressor as claimed in claim 2 wherein said valve means comprises a bimetallic valve element.

4. A scroll compressor as claimed in claim 3 wherein said valve element is circular disk-like in configuration and has a generally spherical central valve portion, said passage means including an annular shoulder which functions as a valve seat engagable by said spherical valve portion.

5. A scroll compressor as claimed in claim 4 wherein valve means is maintained in a normally closed position by the pressure differential thereacross.

6. A scroll compressor as claimed in claim 4 wherein said valve element has a plurality of holes therethrough spaced from said valve portion for permitting the flow of gas therethrough when open.

7. A scroll compressor as claimed in claim 1 further comprising means defining a discharge passage through said non-orbiting scroll member through which compressed gas exits said pockets at the end of each compression cycle, said valve means being disposed in a valve cavity in the wall of said discharge passage.

8. A scroll compressor as claimed in claim 7 wherein said discharge passage comprises a relatively small diameter first axial bore for receiving discharge gas from said pockets and a relatively large diameter second axial bore receiving discharge gas from said first bore, said cavity being in said second bore in the vicinity of the outlet of said first bore.

9. A scroll compressor as claimed in claim 8 wherein said second bore has a relatively flat transverse axially inner surface with said first bore extending from said surface, said vane cavity being disposed in said surface.

10. A scroll compressor as claimed in claim 1 wherein the gas in said sensing zone is at discharge pressure.

11. A scroll compressor as claimed in claim 1 wherein said passage means begins in said non-orbiting scroll and extends radially to the outer periphery thereof.

12. A scroll compressor as claimed in claim 11 further comprising ducting means having an inlet in fluid communication with the outlet of said radial passage means and having an outlet in said motor cavity of said shell.

13. A scroll compressor as claimed in claim 1 wherein said valve means is a pressure responsive valve and said sensed condition is gas pressure.

14. A scroll compressor comprising:

(a) a hermetic shell;

(b) an orbiting scroll member disposed in said shell and having a first spiral wrap on one face thereof;

(c) a non-orbiting scroll member disposed in said shell and having a second spiral wrap on one face thereof, said wraps being entermeshed with one another;

(d) a motor having a motor stator, said motor disposed in said shell for causing said orbiting scroll member to orbit about an axis with respect to said non-orbiting scroll member whereby said wraps will create pockets of progressively decreasing volume from a suction zone at suction pressure to a discharge zone at discharge pressure;

(e) means for introducing suction gas into said shell;

(f) passage means defining a passageway in fluid communication at one end with a sensing zone of compressed gas from said compressor which is at a pressure higher than said suction pressure and at the other end in fluid communication with an area adjacent said motor;

(g) means for controlling gas flow through said passage means, said means operating in response to a sensed condition in said sensing zone in excess of a predetermined value to open said passage means and thereby permit the leakage of compressed gas from said sensing zone to said area adjacent said motor; and (h) a thermal protector associated with said motor for de-energizing said motor when said thermal protector reaches a predetermined excessive temperature, and wherein said leakage of said compressed gas causes an increase in the temperature of said motor and said thermal protector, thereby causing said thermal protector to reach said excessive temperature and de-energize said motor.

15. A scroll compressor as claimed in claim 14 wherein said means for controlling gas flow is a thermal responsive valve and said sensed condition is gas temperature.

16. A scroll compressor as claimed in claim 14 wherein said means for controlling gas flow is a pressure responsive valve and said sensed condition is gas pressure.

17. A scroll compressor as claimed in claim 14 further comprising means for ducting said compressed gas from said sensing zone of compressed gas to an area adjacent said one face of said orbiting scroll member.

18. A scroll compressor as claimed in claim 14 further comprising means for ducting said compressed gas from said sensing zone of compressed gas to an area adjacent said motor stator.

19. A scroll compressor as claimed in claim 18 wherein said area adjacent said motor stator communicates with an opening between said motor stator and said hermetic shell such that said compressor gas is directed towards a portion of said motor opposite to said scroll members.

20. A scroll compressor comprising:

(a) a hermetic shell;

(b) an orbiting scroll member disposed in said shell and having a first spiral wrap on one face thereof;

(c) a non-orbiting scroll member disposed in said shell and having a second spiral wrap on one face thereof, said wraps being entermeshed with one another;

(d) a motor having a motor stator, said motor disposed in said shell for causing said orbiting scroll member to orbit about an axis with respect to said non-orbiting scroll member whereby said wraps will create pockets of progressively decreasing volume from a suction zone at suction pressure to a discharge zone at discharge pressure;

(e) means for introducing suction gas into said shell;

(f) passage means defining a passageway in fluid communication at one end with a thermal responsive valve and at the other end in fluid communication with an area adjacent said motor, said thermal responsive valve in communication with a sensing zone of compressed gas from said compressor;

(g) said thermal responsive valve controlling gas flow through said passage means, said thermal responsive valve operating in response to a sensed temperature in said sensing zone in excess of a predetermined value to open said passage means and thereby permit the leakage of compressed gas from said sensing zone to said area adjacent said motor; and (h) a thermal protector associated with said motor for de-energizing said motor when said thermal protector reaches a predetermined excessive temperature, and wherein said leakage of said compressed gas causes an increase in the temperature of said motor and said thermal protector, thereby causing said thermal protector to reach said excessive temperature and de-energize said motor.

21. A scroll compressor as claimed in claim 20 further comprising means for ducting said compressed gas from said thermal responsive valve to an area adjacent said one face of said orbiting scroll member.

22. A scroll compressor as claimed in claim 20 further comprising means for ducting said compressed gas from said thermal responsive valve to an area adjacent said motor stator.

23. A scroll compressor as claimed in claim 22 wherein said area adjacent said motor stator communicates with an opening between said motor stator and said hermetic shell such that said compressed gas is directed towards a portion of said motor opposite to said scroll member.

24. A scroll compressor comprising:

(a) a hermetic shell;

(b) an orbiting scroll member disposed in said shell and having a first spiral wrap on one face thereof;

(c) a non-orbiting scroll member disposed in said shell and having a second spiral wrap on one face thereof, said wraps being entermeshed with one another;

(d) a motor having a motor stator, said motor disposed in said shell for causing said orbiting scroll member to orbit about an axis with respect to said non-orbiting scroll member whereby said wraps will create pockets of progressively decreasing volume from a suction zone at suction pressure to a discharge zone at discharge pressure;

(e) means for introducing suction gas into said shell;

(f) passage means defining a passageway in fluid communication at one end with a pressure responsive valve and at the other end in fluid communication with an area adjacent said motor, said pressure responsive valve in communication with a sensing zone of compressed gas from said compressor;

(g) said pressure responsive valve controlling gas flow through said passage means, said pressure responsive valve operating in response to a sensed pressure in said sensing zone in excess of a predetermined value to open said passage means and thereby permit the leakage of compressed gas from said sensing zone to said area adjacent said motor; and (h) a thermal protector associated with said motor for de-energizing said motor when said thermal protector reaches a predetermined excessive temperature, and wherein said leakage of said compressed gas causes an increase in the temperature of said motor and said thermal protector, thereby causing said thermal protector to reach said excessive temperature and de-energize said motor.

25. A scroll compressor as claimed in claim 24 further comprising means for ducting said compressed gas from said pressure responsive valve to an area adjacent said one face of said orbiting scroll member.

26. A scroll compressor as claimed in claim 24 further comprising means for ducting said compressed gas from said pressure responsive valve to an area adjacent said motor stator.

27. A scroll compressor as claimed in claim 26 wherein said area adjacent said motor stator communicates with an opening between said motor stator and said hermetic shell such that said compressed gas is directed towards a portion of said motor opposite to said scroll member.

28. A scroll compressor comprising:

(a) a hermetic shell;

(b) an orbiting scroll member disposed in said shell and having a first spiral wrap on one face thereof;

(c) a non-orbiting scroll member disposed in said shell and having a second spiral wrap on one face thereof, said wraps being entermeshed with one another;

(d) a motor having a motor stator, said motor disposed in said shell for causing said orbiting scroll member to orbit about an axis with respect to said non-orbiting scroll member whereby said wraps will create pockets of progressively decreasing volume from a suction zone at suction pressure to a discharge zone at discharge pressure;

(e) means for introducing suction gas into said shell;

(f) passage means defining a passageway in fluid communication at one end with both a thermal responsive valve and a pressure responsive valve and at the other end in fluid communication with an area adjacent said motor, said thermal responsive valve and said pressure responsive valve in communication with a sensing zone of compressed gas from said compressor;

(g) said thermal responsive valve and said pressure responsive valve controlling gas flow through said passage means, said valves operating in response to sensed conditions in said sensing zone in excess of predetermined values to open said passage means and thereby permit the leakage of compressed gas from said sensing zone to said area adjacent said motor; and (h) a thermal protector associated with said motor for de-energizing said motor when said thermal protector reaches a predetermined excessive temperature, and wherein said leakage of said compressed gas causes an increase in the temperature of said motor and said thermal protector, thereby causing said thermal protector to reach said excessive temperature and de-energize said motor.

29. A scroll compressor as claimed in claim 28 further comprising means for ducting said compressed gas from said thermal responsive valve and said pressure responsive valve to an area adjacent said one face of said orbiting scroll member.

30. A scroll compressor as claimed in claim 28 further comprising means for ducting said compressed gas from said thermal responsive valve and said pressure responsive valve to an area adjacent said motor stator.

31. A scroll compressor as claimed in claim 30 wherein said area adjacent said motor stator communicates with an opening between said motor stator and said hermetic shell such that said compressed gas is directed towards a portion of said motor opposite to said scroll member.

32. A scroll compressor comprising:

a hermetic shell;

a first scroll member disposed in said shell and having a first spiral wrap on one face thereof;

a second scroll member disposed in said shell and having a second spiral wrap on one face thereof, said wraps being intermeshed with one another;

a motor in said shell for causing said first scroll member to orbit with respect to said second scroll member whereby said wraps will create pockets of progressively decreasing volume from a suction zone to a discharge zone;

passage means defining a first passageway in fluid communication at one end with said discharge zone and at the other end with said suction zone; and a normally closed thermally responsive valve member in said passage means for controlling gas flow therethrough, said valve member operating in response to a sensed temperature in excess of a predetermined value to open said passage means and thereby permit the leakage of gas from said discharge zone to said suction zone.

33. The scroll compressor according to claim 32 further comprising a thermal protector on said motor for de-energizing said motor when said thermal projector reaches a predetermined temperature, and wherein said leakage of said gas from said discharge zone to said suction zone causes said thermal protector to trip and de-energize said motor.

34. The scroll compressor according to claim 32 wherein the outlet of said passage means is in the vicinity of said motor.

35. The scroll compressor according to claim 32 wherein said passage means is in said second scroll and extends radially to the outer periphery thereof.

36. The scroll compressor according to claim 32 further comprising a guide member having an inlet in fluid communication with said passage means and an outlet in the vicinity of said motor.

37. The scroll compressor according to claim 36 wherein said guide member is a tube.

38. The scroll compressor according to claim 36 wherein said guide member is a duct, said duct directing said gas to a lower portion of said shell.

39. The scroll compressor according to claim 38 wherein said duct directs said gas toward a portion of said motor opposite to said scroll members.

40. The scroll compressor according to claim 38 wherein said motor includes a motor stator and said duct directs said gas to an area adjacent said motor stator.

41. The scroll compressor according to claim 32 wherein said valve member comprises a bimetallic valve element.

42. The scroll compressor according to claim 41 wherein said valve member is circular disk-like in configuration and has a generally spherical central valve portion, said passage means including an annular shoulder which functions as a valve seat engageable by said spherical valve portion.

43. The scroll compressor according to claim 41 wherein said valve member is maintained in said closed position by the pressure differential thereacross.

44. The scroll compressor according to claim 41 wherein said valve element has a plurality of holes therethrough spaced from said valve portion of permitting flow of gas therethrough when open.

45. The scroll compressor according to claim 32 wherein said second scroll member defines a discharge passage through which compressed gas exits said pockets at the end of each compression cycle, said valve means being disposed in a valve cavity in a wall of said discharge passage.

46. The scroll compressor according to claim 45 wherein said second scroll member defines a secondary flow passage extending between said discharge passage and said valve cavity.

47. The scroll compressor according to claim 45 wherein said discharge passage comprises a relatively small diameter first axial bore for receiving discharge gas from said pockets and a relatively large diameter axial bore for receiving discharge gas from said first axial bore, said valve cavity being in said second axial bore in the vicinity of the outlet of said first axial bore.

* * * * *

UNITED STATES PATENT AND TRADEMARK OFFICE

CERTIFICATE OF CORRECTION

PATENT NO. : 5,527,158

DATED : June 18, 1996

INVENTOR(S) : Jeffery D. Ramsey; Jean-Luc Caillat; Sunil S. Kulkarni

It is certified that error appears in the above-indentified patent and that said Letters Patent is hereby corrected as shown below:

Abstract, line 2, "motorcompressor" should be -- motor-compressor --.

Abstract, line 6, "motor" should be -- for --.

Column 1, line 17, "entermeshed" should be -- intermeshed --.

Column 4, line 27, "therefor" should be -- therefore --.

Column 4, lines 44 & 45, "applicant's" should be -- applicants' --.

Column 4, line 60, "applicant's" should be -- applicants' --.

Column 6, line 2, "(" should be deleted.

Column 7, line 35, "entermeshed" should be -- intermeshed --.

Column 8, line 30, "vane" should be -- valve --.

Column 8, line 49, "entermeshed" should be -- intermeshed --.

Column 9, line 35, "entermeshed" should be -- intermeshed --.

Column 10, line 18, "entermeshed" should be -- intermeshed --.

UNITED STATES PATENT AND TRADEMARK OFFICE

CERTIFICATE OF CORRECTION

PATENT NO. : 5,527,158

DATED : June 18, 1996

INVENTOR(S) : Jeffery D. Ramsey; Jean-Luc Caillat; Sunil S. Kulkarni

It is certified that error appears in the above-indentified patent and that said Letters Patent is hereby corrected as shown below:

Column 10, line 67, "entermeshed" should be -- intermeshed --.

Signed and Sealed this

Fifteenth Day of April, 1997

Bruce Lehman

*Attest:*

BRUCE LEHMAN

*Attesting Officer*

*Commissioner of Patents and Trademarks*